US008858115B2

(12) United States Patent
Geary

(10) Patent No.: US 8,858,115 B2
(45) **Date of Patent: *Oct. 14, 2014**

(54) POTHOLE AND UTILITY CUT REPAIR OVERLAY AND METHOD OF INSTALLATION

(71) Applicant: Geary Trust, The, Santa Rosa Valley, CA (US)

(72) Inventor: Timothy Geary, Camarillo, CA (US)

(73) Assignee: Geary Trust, The, Camarillo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/027,396

(22) Filed: Sep. 16, 2013

(65) Prior Publication Data

US 2014/0017004 A1 Jan. 16, 2014

Related U.S. Application Data

(63) Continuation-in-part of application No. 13/413,999, filed on Mar. 7, 2012, now Pat. No. 8,534,954, which is a continuation of application No. PCT/US2013/029211, filed on Mar. 5, 2013.

(60) Provisional application No. 61/487,926, filed on May 19, 2011.

(51) Int. Cl.

| | |
|---|---|
| ***E01C 3/06*** | (2006.01) |
| ***E01C 23/10*** | (2006.01) |
| ***E01C 5/12*** | (2006.01) |
| ***E01C 11/00*** | (2006.01) |
| ***E01C 23/06*** | (2006.01) |

(52) U.S. Cl.

CPC . *E01C 23/10* (2013.01); *E01C 5/12* (2013.01); *E01C 11/005* (2013.01); *E01C 23/06* (2013.01)

USPC ..... 404/31; 404/70; 404/75

(58) Field of Classification Search

USPC ..... 404/31, 35, 45, 70, 71, 75

See application file for complete search history.

(56) References Cited

U.S. PATENT DOCUMENTS

| | | | | |
|---|---|---|---|---|
| 4,113,401 | A | 9/1978 | McDonald | |
| 4,507,013 | A | 3/1985 | Martinak | |
| 4,684,288 | A | 8/1987 | Chapa | |
| 4,744,693 | A | 5/1988 | Smith | |
| 5,183,353 | A | 2/1993 | Buckelew | |
| 5,464,303 | A | 11/1995 | Wells | |
| 5,660,498 | A | 8/1997 | Freeman | |
| 5,749,674 | A | 5/1998 | Wilson | |
| 5,829,914 | A | 11/1998 | Wells | |
| 5,947,634 | A | 9/1999 | Robillard | |
| 7,232,276 | B2 | 6/2007 | Oka et al. | |
| 8,142,102 | B2 | 3/2012 | Wheatley | |
| 8,534,954 | B2 * | 9/2013 | Geary | 404/31 |
| 2006/0165485 | A1 | 7/2006 | Lowe | |
| 2009/0056261 | A1 * | 3/2009 | Damgaard | 52/408 |
| 2009/0067926 | A1 | 3/2009 | Greer | |

FOREIGN PATENT DOCUMENTS

| | | |
|---|---|---|
| BY | 8020 | 6/2004 |
| SU | 1825836 A1 | 7/1993 |

* cited by examiner

*Primary Examiner* — Gary Hartmann

(74) *Attorney, Agent, or Firm* — Ralph D. Chabot

(57) ABSTRACT

A road overlay product for protecting a repaired road portion including repaired potholes and utility cuts. A pothole or utility cut is preliminarily repaired with asphalt fill and compacted per current standard practice. Thereafter, the overlay is placed upon the compacted top surface of the asphalt fill, overlapping onto the adjacent road surface and compressed. The overlay forms a water proof seal preventing water from seeping into the repaired area. The overlay also resists crack propagation and minimizes the potential of asphalt chipping and the breaking down of the asphalt fill and surrounding roadway.

12 Claims, 2 Drawing Sheets

POTHOLE AND UTILITY CUT REPAIR OVERLAY AND METHOD OF INSTALLATION

BACKGROUND OF THE INVENTION

This invention relates to pothole and utility cut repairs on roadways and highways.

Potholes and utility cuts are a common occurrence on roadways in which potholes develop over time as a result of a weakness in the original roadway installation and utility cuts cause damage, over time, in otherwise solid roadways. This weakness can be the result of an improper compaction of the roadway base where, over time and with cyclic loading from vehicular traffic, small cracks are created, particularly at joints, after which water can seep into the cracks and propagate the cracks further; either by the hydraulic force created by the cyclic loading, or from the water freezing in frigid environments.

Potholes and damage caused by utility cuts are formed by water flowing through cracks in old or weakened asphalt. The water is soaked up by the base mixture of rock, gravel, and sand that supports the roadway surface. Vehicles passing over the road force water through the soggy roadway base, eventually causing saturated compaction below the roadway surface. Asphalt sinks into the saturated portions of the roadbed and eventually causing cracks under the continued impact of vehicle tires. The end result causes asphalt or concrete to become displaced in fragments large and small, from the roadway surfaces.

After a pothole or utility cut damage occurs, the repair typically comprises the placement of a sufficient amount of asphalt to fill the pothole or damaged area. This asphalt is, at the time of placement, soft and compressible. Following placement, the asphalt is compressed so that it is substantially level with the overall road surface.

Problems can occur frequently with this sort of repair activity. First, the asphalt may not have been sufficiently compressed and/or allowed to cure properly. Before becoming fully cured, asphalt is very pliable and prone to developing fractures, particularly at or near the joint edge located adjacent to the surrounding road surface. This portion of the asphalt fill is susceptible to crack development due to its proximity on one side to a rigid, cured road surface and on the other side to pliable, uncured asphalt. In addition, none of the aggregate filler crosses the boundary, leaving an unreinforced zone at the joint. Slight fractures that developed soon after application can propagate as a result of water intrusion and freezing. The interface between asphalt fill perimeter and existing road surface can develop pathways for water to collect below the pothole repair surface causing base compaction and/or erosion.

Over time, the asphalt fill will cure and harden. However, because of real world situations, the fill does not have the necessary time to cure completely before being subjected to weathering and repetitive load conditions resulting from vehicular traffic. This often times results in the same locations being repaired over and over. Thus, a problem with present methods for repairing potholes and utility cut damage is that the repair oftentimes is only a temporary fix, and over time, the repetitive repair results in increasingly high repetitive costs.

Representative of the techniques developed in the past to address pothole repair include U.S. Pat. No. 5,829,914 issued to Wells; U.S. Pat. No. 5,749,674 issued to Wilson, Sr.; U.S. Pat. No. 8,142,102 issued to Wheatley; and, Soviet Pat. No. SU 1825836. These references describe various methods for repairing potholes; all of which include the on-site construction systems of a fill for placement in a pothole. Belarus Pat. No. BY 8020 discloses a method for repairing a worn portion of a concrete roadway by cutting a truncated pyramidal cavity into the roadway and filled with a plug having dimensions and shape similar to the cavity. Each of these references can add to the overall cost of the repair as a result of the labor intensive activity associated with the on-site fabrication techniques described. The prior art references discussed above are hereby incorporated by reference.

Expenditures caused by potholes and utility cuts are not limited to the cost of road repair. It has also been reported that the damage to vehicles have cost insurance companies approximately five billion dollars in 2010 alone.

SUMMARY OF THE INVENTION

An overlay product for placement on a repaired road portion is presented.

As used herein, the term "repaired road portion" means a repaired pothole or a repair to a failed utility cut. The repaired road portion has an asphalt top surface, as a result of the asphalt fill used for repairing the road portion. However, other fill material besides asphalt, such as concrete, can also be included in this definition.

The overlay product can be mass produced in a quality controlled manufacturing facility. Rather than creating the overlay layer-by-layer at the site of repair as described in the earlier cited prior art references, my pre-fabricated overlay product can be transported and quickly applied to a repaired road portion. This is an advantage over the prior art described earlier since less time is required for site preparation and placement which significantly reduces labor costs. Placement of the pre-fabricated overlay product is simple and minimal time is required to adhere the overlay to the repaired road portion. Installation immediately following repair of the road portion provides waterproof protection; thereby preventing continued failure of the road portion by water intrusion and periphery disintegration of the repair. The overlay, properly installed, will eliminate costs associated with repeated repair work to the same, but larger road portion. My overlay product provides an environment allowing the filler, preferably asphalt filler (either hot or cold) to resist exposed crack propagation and/or disintegration while curing and thereby resulting in a more durable and longer service life.

The invention comprises a lamination of a wear layer, structural reinforcement layer, and a peel-off film backing. The wear layer is made of cured bitumen and having a top surface composed of a material for frictional contact with the tires of oncoming traffic to provide traction similar to the surrounding roadway surface. Preferably, the top surface of the wear layer consists essentially of a frit such as aggregate stone or ceramic particles; such frit being partially embedded in the wear layer bitumen. Below the wear layer is a structural reinforcement layer made of viscous bitumen and will be described in greater detail later in this disclosure.

The overlay lamination can be manufactured either with or without a layer of sealant disposed beneath the structural reinforcement layer. In a preferred embodiment, the overlay is manufactured having a layer of sealant with a disposable film backing placed upon the exposed side of the sealant to prevent premature curing and/or attachment to the contiguous overlay during shipping and storage. Use of a correct sealant is necessary to not only form a seal or barrier with the surrounding adjacent road surface to prevent water migration into the repaired road portion but also to secure the overlay in position The sealant used is preferably an uncured, un-oxidized, viscous bitumen including those of the modified viscous types. The thickness of the sealant layer needs to be sufficient to conform to the voids in the top surface of the repaired road portion for greater adhesion. An insufficient sealant thickness will only contact the peaks present as part of the top surface and will not create a sufficient environment for the sealant to permanently bond to the repaired roadway surface portion. In some regions having certain temperature and climate conditions, the addition of loose fibers and/or particles may be added to improve the strength of the sealant as is known to those having skill in the art.

Both the wear layer and structural reinforcement layer respectively have cured bitumen and viscous bitumen compositions which have differing curing and oxidizing characteristics. These characteristics can be altered to accommodate regional requirements regarding temperature and climate for roadway repairs.

By way of explanation, it is preferred that the bitumen matrix of the structural reinforcement layer be pliable, non-rigid and displaceable, but not displaceable to the degree as required for the sealant layer which is required for bonding with the adjacent road surface. By contrast, the bitumen matrix and wetted fibers of the structural reinforcement layer must maintain its basic thickness to accommodate the reinforcing materials performance as discussed later.

With regard to the bitumen of the wear layer, it is preferred that the curing and oxidizing characteristics result in a more rigid layer than the structural reinforcement layer and most preferably should be substantially cured or oxidized. As used herein, partially embedded means that the lower portion of the frit particles is in contact with the bitumen matrix of the wear layer while the top portion of the frit particles remain exposed.

If the overlay does not include a layer of sealant, sealant can be applied to the surface of the repaired pot hole prior to positioning of the overlay by those having skill in the art which accordingly is well known in prior art.

The frit used in my overlay is designed to have a similar coefficient of friction as that of the surrounding roadway. The overlay forms a structural reinforced barrier resistant to water intrusion, crumbling, cracking as well as ultra-violet (UV) protection. Properly installed, my overlay product forms a barrier with the adjacent surrounding road surface thereby preventing the most common cause of failure; that being water seepage which generally accelerates breakdown of the asphalt fill and surrounding roadway surface.

The overlay must be appropriately sized to cover the surface area of the repaired road portion and have sufficient contact with the surrounding roadway surface to create a water proof seal and structural tie. An oversized overlay is not detrimental. However, the overlay must be sufficiently durable to withstand cyclic compressive loads from the weight of oncoming vehicles as well as weathering.

As discussed earlier, the top surface is designed for frictional contact with vehicular tires having a similar frictional characteristic to the surrounding roadway surface. In a preferred embodiment, the wear layer comprises exposed stone or ceramic frit embedded in a cured bitumen matrix which optionally may contain fibers. Thus, the frictional top surface of the wear layer could be referred to as a "fritted layer" which in one embodiment is sealed or laminated to a viscous bitumen embedded fiber layer that can be defined as "fiber ladened" viscous bitumen layer.

It should be noted that once the overlay is manufactured, it may not be able to subsequently distinguish the transition from the structural reinforcement layer to the sealant layer. Because both layers are not cured at the time of manufacture, it is possible that a transition phase will exist being made up of bitumen from both layers.

Preferably, the top surface of the overlay is designed to color blend with the cosmetic appearance of the existing street surface.

The structural reinforcement layer is a composite comprised of a viscous bitumen reinforced with: a) fibrous material thus forming a composite; b) a mesh screen encapsulated within the bitumen; or, c) a combination of a) and b). Reinforcement of the viscous bitumen with a mesh screen and/or fibrous materials not only resists crack development and provides strength and continuity but also functions as an additional moisture seal. Reinforcement thus resists shearing or tearing forces which may occur as a result of a vehicular tire at rest turning to a different direction.

The reinforcing materials which comprise a portion of the structural reinforcement layer strengthen the overlay so that it is capable of being subjected to repetitive high load conditions and expansions and contractions while it maintains structural integrity necessary to prevent crack propagation and maintain a continuous seal over the overlay product covered area.

Fibers and filaments which are suitable for reinforcement include substances having a high modulus of elasticity and are capable of being subjected to repetitive high load conditions and maintain structural integrity necessary to restrain crack propagation. Examples of such fibrous material include those made from: a) natural vegetable fibers such as abaca, bamboo, coir, cotton, flax/linen, hemp, jute, kapok, kenaf, pina raffia, ramie, sisal and wood; b) mineral fibers such as E-glass S-glass, continuous basalt fiber, carbon graphite, metallic and steel wool; c) man-made cellulose fibers such as acetate, bagasse, bamboo, triacetaste, artsilk, rayon, seasell and viscose; and d) polymers such as acrylic, aramid (twaron, Kevlar, technora, Nomex), melamine, microfiber, modacylic, nylon, olefin, polyester, polyamide, polyamid, polyethylene, vinylon and zylon; and e) combinations thereof.

Thus, the invention accomplishes three functions. First, the top surface is designed for UV protection, traction and wear resistance, i.e., periodic contact with the tires of oncoming vehicular traffic. Second, the structural reinforcement layer is for providing strength, structural continuity (tie to surrounding roadway) and longevity to the overlay. Third, the layer of sealant is preferably a non-fibered viscous bitumen, for adhesion to the roadway and minor expansion past the edges of the overlay. Additionally, through continued roadway use, the cyclic tire compression of the overlay causes the layered strata of the overlay to compress adding much greater strength and adds to the ultimate goal of compaction into the repaired roadway asphalt and/or concrete for permanent sealing and containment of the repair.

The road overlay can be manufactured in various sizes and shapes. The proper size for a particular application is where the overlay will have a slightly larger perimeter than the repair surface itself. For larger potholes or utility cuts where a single overlay is not of a sufficient size, multiple overlays can be applied by overlapping the overlays edges. What is most important is that the overlay surface area be sufficiently large to not only cover the repaired surface area but to also sufficiently overlap with the surrounding road surface, and then, following a compressive force applied to the top surface of the overlay, the sealant layer is forced upon the road surface to create a water proof and containment seal. The overlap also provides a structural tie to the adjacent roadbed to minimize or even eliminate propagation of cracks in the asphalt fill and contain fragments of the repair. The overlay can also be in the form of a donut ring for placement around the perimeter of manhole covers and other utility covers, typically lifted and patched after repaving. Thus, the overlay is not limited to uses strictly related to potholes.

Because of the materials used in manufacture, overlay products can be stacked and shipped in a multiple unit pile and thereafter easily separated for use. The overlay itself has sufficient internal strength to tolerate lifting, turning, and flexing without tearing prior to installation and can maintain its general shape during its installation.

The overlay is sufficiently thin so that following proper installation, the vertical height of the overlay, relative to the surrounding road surface, will be minimal. The vertical height of the overlay above the adjacent road surface will not cause damage to a vehicle's suspension or become a nuisance to vehicular travelers.

A method for installing one embodiment of my overlay will now be discussed. The repaired road portion is performed according to standard operating procedure well known in prior art and includes compaction of the fill. The top surface of the repaired road portion generally will be the same or slightly higher than the surrounding road surface after compaction (although in some cases it may be lower than the adjacent roadway). Following this compaction procedure, my overlay product is brought to the site of the repaired road portion and the non-stick disposable film backing is removed with the overlay placed upon the repaired road portion so that the sealant layer is in contact not only with the top surface of the compacted fill, but also with the surrounding road surface. Preferably, the overlap of the overlay to the surrounding road surface is at least 2 inches. After the overlay is placed, a second compaction occurs over the entire overlay surface to ensure complete contact and adhesion between the overlay, the fill and the adjacent road surface.

Over time, the overlay and the fill below completely cure and are bonded to one another. The structural reinforcement layer, particularly the mesh screen and/or fibrous filaments, provide a layer which resists cracking, water intrusion, asphalt fracturing, and retains asphalt fragments.

For wet weather environments, an optional design feature comprises a plurality of holes extending through the entire laminate of the overlay; preferably leaving visible holes on 1" to 2" centers. These holes will allow air and any moisture present to vent during installation and achieve full surface contact and adhesion. Use of overlays having the aforementioned holes will prevent undesired entrapment of bubbles under the overlay product surface. The viscosity of the bitumen used therefore must be sufficiently fluid so that compaction will cause the viscous bitumen to displace and close off the holes. It is believed that if air and water have a pathway to escape from the pothole while the asphalt fill is new, the sealing and protection will be more effective and consistent.

In another embodiment, the pre-fabricated overlay can consist essentially of: 1) a wear layer composed of bitumen having a top surface of frit partially embedded therein; 2) a bottom layer of sealant; 3) a structural reinforcement layer of viscous bitumen disposed between the wear layer and the bottom layer of sealant where the structural reinforcement layer includes a reinforcement component selected from the group consisting of: a) fibrous material disposed within said viscous bitumen; b) a mesh screen encapsulated within said viscous bitumen; and, c) a combination of a) and b); and, 4) a peel off film backing disposed upon exposed surface of the bottom layer of sealant.

It is to be understood that as new chemicals, composites and laminate materials are developed in the future, these are intended to be covered by my invention so long as the product is capable of creating a water seal while maintaining containment of displaced large and small asphalt or concrete particles beneath the overlay product.

The applications to which domestic benefit is claimed are hereby incorporated by reference.

DETAILED DESCRIPTION OF THE PREFERRED EMBODIMENT

Figure 1:
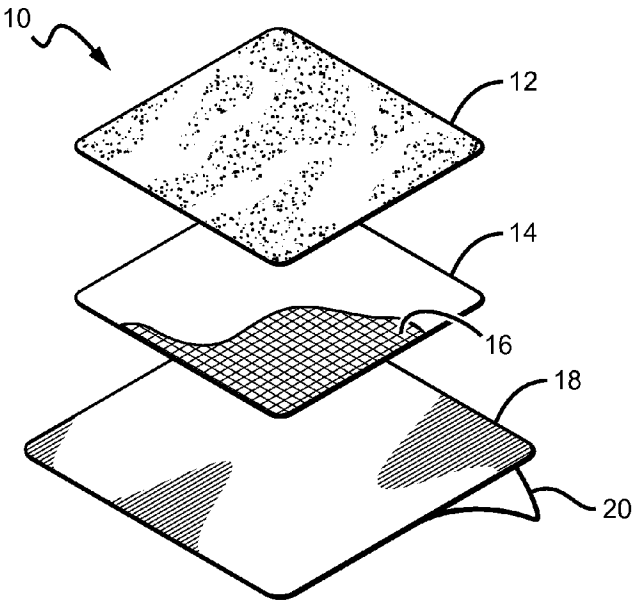
FIG. 1 is an exploded view of the overlay made according to my invention.

FIG. 1 illustrates my laminated overlay 10 for pothole repair. It is to be understood that the figures presented are not to any scale and are provided for a general understanding of the overlay structure and method of use.

As used herein, the term "about" means 10% plus or minus of the stated value.

Overlay 10 has a top wear layer 12 comprising a top surface of stone frit filler embedded in a 1/16-1/8 inch thick modified asphalt which could be also reinforced with fiber. A structural reinforcement layer 14 is comprised of viscous bitumen blended with oriented fibrous material and further having encapsulated oriented fibers 16 with an overall layer thickness of about 1/16 inch. A bottom sealant layer 18 comprises about 1/8 inch thick bitumen. A peel-off non-stick film backing 20 is affixed to the lower surface of sealant layer 18 and which is removed prior to application.

Figure 2:
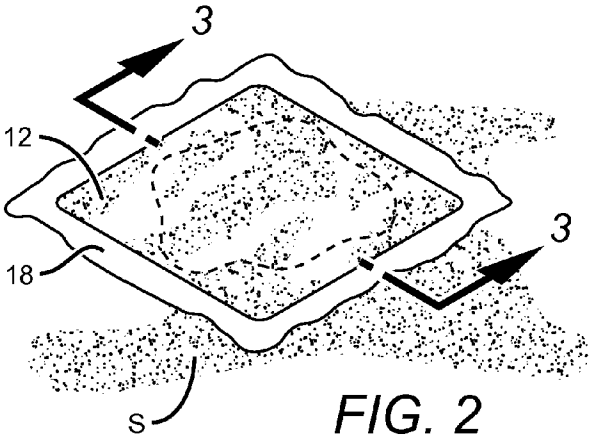
FIG. 2 is a view of how my overlay would be applied upon a street.

FIG. 2 illustrates the position of overlay 10 on a road surface S once installation is complete.

Figure 3:
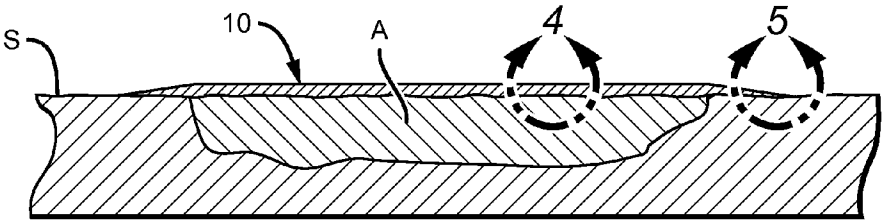
FIG. 3 is a view taken along line 3-3 of FIG. 2.
Figure 4:
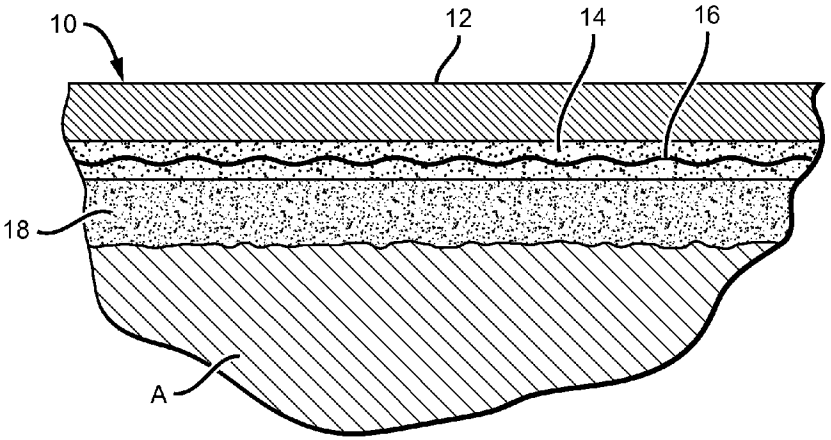
FIG. 4 is a view taken along line 4 of FIG. 3.
Figure 5:
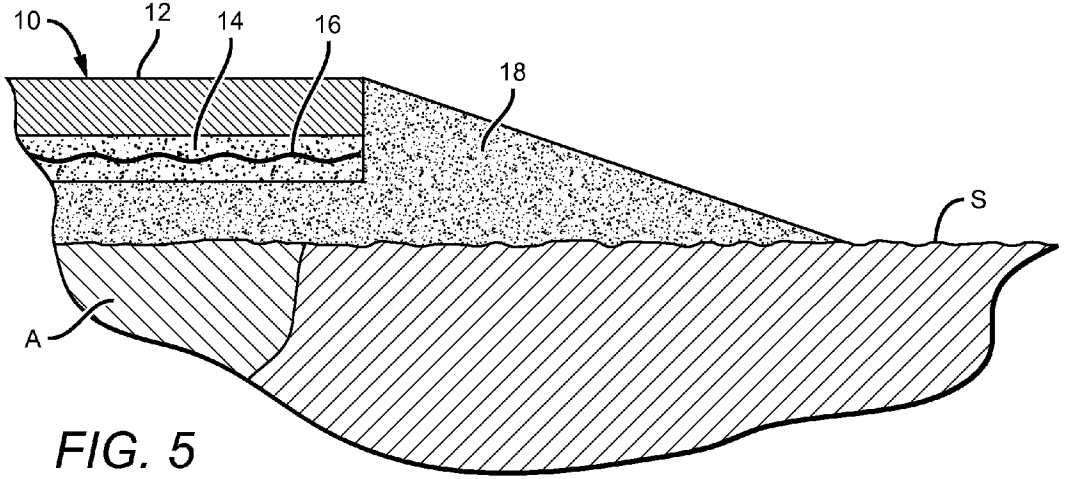
FIG. 5 is a view taken along line 5 of FIG. 3.

FIGS. 3-5 illustrate the relationship of overlay 10 relative to road surface S and asphalt fill A following installation.

The method for placement includes first sweeping off edges of the repair area to ensure no loose material or debris are present and then the pothole is filled with either hot or cold asphalt. A sufficient compressive force is applied to compact asphalt fill A using current fill and repair practices which includes removal of any excess fill material An appropriately sized overlay 10 is selected for placement upon asphalt fill A which overlaps with the adjacent road surface S surrounding asphalt fill A. Disposable film backing 20 is removed and overlay 10 laid upon the surface of asphalt fill A where overlay 10 overlaps the adjacent road surface S by at least 2" beyond the repair on all sides. A second compressive force is applied, this time upon overlay 10 to compress overlay 10 into contact and bond with asphalt fill A and road surface S to prevent water intrusion. As is best illustrated in FIGS. 4 and 5, following compressions of overlay 10, a portions of the viscous bitumen layer 18 is displaced outward into contact with road surface S as well as downward into intimate contact with both surface S and the top surface of asphalt fill A. This contact creates the water proof seal for preventing water from having a pathway to detrimentally breaking down the asphalt fill A.

I claim:

1. A pre-fabricated water-proof overlay for placement upon a repaired road portion, the pre-fabricated water-proof overlay comprising:

a lamination of:

a wear layer composed of cured bitumen, said wear layer having a top surface of frit partially embedded therein;

a structural reinforcement layer disposed beneath said wear layer and comprised of viscous bitumen; said structural reinforcement layer further comprising a reinforcement component selected from the group consisting of: a) fibrous material disposed within said viscous bitumen; b) a mesh screen encapsulated within said viscous bitumen; and, c) a combination of a) and b); and, a peel off film backing disposed beneath said structural reinforcement layer.

2. The overlay of claim 1 further comprising a layer of uncured sealant disposed between said peel off backing and said structural reinforcement layer.

3. The overlay of claim 1 where said frit is selected from the group consisting of aggregate stone, ceramic, or a combination of both.

4. The overlay of claim 2 where said frit is selected from the group consisting of aggregate stone, ceramic, or a combination of both.

5. The overlay of claim 1 where said fibrous material is selected from the group consisting of: abaca, bamboo, coir, cotton, flax/linen, hemp, jute, kapok, kenaf, pina raffia, ramie, sisal, wood, E-glass, S-glass, continuous basalt fiber, carbon graphite, metallic and steel wool, acetate, bagasse, bamboo, triacetaste, artsilk, rayon, seasell, viscose, acrylic, aramid (twaron, Kevlar, technora, Nomex), melamine, microfiber, modacylic, nylon, olefin, polyester, polyamide, polyamid, polyethylene, vinylon, zylon, and combinations thereof.

6. The overlay of claim 1 where the top surface of said wear layer cosmetically color blends with the surrounding road surface.

7. The overlay of claim 2 where said layer of sealant is of sufficient volume to provide a water proof seal when applied and compressed upon the surface of an existing roadway adjacent to a repaired road portion.

8. The overlay of claim 7 where said sealant is an uncured viscous bitumen.

9. The overlay of claim 2 where said wear layer has a thickness of between about 1/16 to 3/16 inch.

10. A pre-fabricated overlay to cover a repaired road portion and the adjacent roadway surface consisting essentially of:

a wear layer composed of bitumen, said wear layer having a top surface of frit partially embedded therein;

a bottom layer of sealant;

a structural reinforcement layer comprised of viscous bitumen disposed between said wear layer and said bottom layer of sealant; said structural reinforcement layer further comprising a reinforcement component selected from the group consisting of: a) fibrous material disposed within said viscous bitumen; b) a mesh screen encapsulated within said viscous bitumen; and, c) a combination of a) and b); and, a peel off film backing disposed upon said layer of sealant.

11. The overlay of claim 10 where said frit is selected from a group consisting of aggregate stone, ceramic or a combination of both.

12. A method for protecting a repaired road portion comprising the steps of:

providing a repaired road portion having a fill selected from the group consisting of asphalt or concrete;

providing a pre-fabricated overlay, said pre-fabricated overlay comprising a lamination of:

a) a top wear layer having a top surface constructed of a material for providing a comparable level of traction to vehicular tires as the surrounding road surface, and a bottom surface; and, b) a structural reinforcement layer disposed beneath said wear layer and comprising viscous bitumen and a reinforcement component selected from the group consisting of: i) fibrous material disposed within said viscous bitumen, ii) a mesh screen encapsulated within said viscous bitumen, and, iii) a combination of i) and ii);

a peel off backing disposed beneath said structural reinforcement layer;

said pre-fabricated overlay further sufficiently sized to cover said repaired road portion and a portion of the surrounding road surface to form a moisture barrier following application of a compressive force;

removing said peel off backing from said pre-fabricated overlay and positioning said bottom surface of the remainder of said pre-fabricated overlay upon said repaired road portion; and, applying a compressive load to said remainder of said pre-fabricated overlay.

* * * * *